US006443566B1

(12) United States Patent
Watanabe et al.

(10) Patent No.: US 6,443,566 B1
(45) Date of Patent: Sep. 3, 2002

(54) INK-JET HEAD AND METHOD OF MANUFACTURING THE SAME

(75) Inventors: Osamu Watanabe; Hidetoshi Tanoue, both of Kumamoto; Isaku Kanno, Nara; Kenji Tomita, Kumamoto, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/016,711

(22) Filed: Dec. 14, 2001

Related U.S. Application Data

(62) Division of application No. 09/439,955, filed on Nov. 12, 1999.

(30) Foreign Application Priority Data

Nov. 16, 1998 (JP) ..... 10-325508

(51) Int. Cl.[7] ..... B41J 2/045
(52) U.S. Cl. ..... 347/68; 347/70
(58) Field of Search ..... 347/68, 70, 71, 347/72, 54

(56) References Cited

U.S. PATENT DOCUMENTS 4,866,460 A 9/1989 Shiozaki
5,818,482 A * 10/1998 Ohta et al. ..... 347/70
5,933,170 A * 8/1999 Takeuchi et al. ..... 347/71
6,158,847 A * 12/2000 Usui et al. ..... 347/70
6,217,158 B1 * 4/2001 Kanaya et al. ..... 347/70
6,231,169 B1 * 5/2001 Yazaki et al. ..... 347/70

FOREIGN PATENT DOCUMENTS

| | | |
|---|---|---|
| JP | 7-148921 | 6/1995 |
| JP | 7-156384 | 6/1995 |
| JP | 7-202284 | 8/1995 |
| JP | 8-1933 | 1/1996 |
| JP | 10-286953 | 10/1998 |
| WO | WO97-03834 | 2/1997 |

* cited by examiner

*Primary Examiner*—Thinh Nguyen
(74) *Attorney, Agent, or Firm*—Harness, Dickey & Pierce, P.L.C.

(57) ABSTRACT

The method of manufacturing an ink-jet head of this invention includes the steps of forming plural individual electrodes and plural piezoelectric devices stacked in this order on a supporting substrate; flattening a top surface of the supporting substrate including the individual electrodes and the piezoelectric devices by filling a filler in a portion on the supporting substrate where the individual electrodes and the piezoelectric devices are not formed up to substantially the same level as a level of upper surfaces of the piezoelectric devices; forming a common electrode on the entire flattened top surface of the supporting substrate; fixing a pressure chamber part for forming pressure chambers on the common electrode; and removing the supporting substrate after fixing the pressure chamber part on the common electrode. Thus, the entire plane on which the common electrode is to be formed is flattened before forming the common electrode.

3 Claims, 9 Drawing Sheets

INK-JET HEAD AND METHOD OF MANUFACTURING THE SAME

This application is a divisional of U.S. application Ser. No. 09/439,955 filed on Nov. 12, 1999, and entitled "Method of Manufacturing for an Ink-Jet Head" the specification and drawings of which are hereby expressly incorporated by reference.

BACKGROUND OF THE INVENTION

The present invention relates to an ink-jet head for jetting ink by using a piezoelectric effect of a piezoelectric device and a method of manufacturing the same.

Recently, ink-jet printers are widely used in offices and households. Various systems have been proposed for ink-jet heads used in the ink-jet printers in order to meet recent demands for low noise and high print quality. In general, the systems for the ink-jet heads can be roughly divided into the following two systems:

In a first system, part of an ink passage and an ink chamber is formed into a pressure chamber by using a piezoelectric actuator having a piezoelectric device, and a pulse voltage is applied to the piezoelectric device so as to deform the piezoelectric actuator. Thus, the pressure chamber is deformed to have a smaller volume, thereby generating a pressure pulse within the pressure chamber. By using the pressure pulse, ink drops are jetted through a nozzle hole communicating with the pressure chamber.

In a second system, an exothermic resistance is provided in an ink passage, and a pulse voltage is applied to the exothermic resistance so as to generate heat therein. Thus, ink contained in the passage is boiled with vapor bubble generated. By using the pressure of the vapor bubble, ink drops are jetted through a nozzle hole.

The present invention relates to an ink-jet head of the first system, and hence, this system will be further described in detail. FIGS. 7 through 9 show an exemplified conventional ink-jet head of the first system, and the ink-jet head comprises a head body 101 including a plurality of pressure chamber concaves 102 each having a supply port 102*a* for supplying ink and a discharge port 102*b* for discharging ink. The concaves 102 of the head body 101 are arranged along one direction at predetermined intervals.

The head body 101 includes a pressure chamber part 105 forming the side walls of the concaves 102, an ink passage part 106 forming the bottoms of the concaves 102 and including plurality of thin plates adhered to one another, and a nozzle plate 113. Within the ink passage part 106, an ink supply passage 107 communicating with the supply port 102*a* of each concave 102 and an ink discharge passage 108 communicating with the discharge port 102*b* of each concave 102 are formed. Each ink supply passage 107 communicates with an ink supply chamber 110 extending in the direction of arranging the concaves 102, and the ink supply chamber 110 communicates with an ink supply hole 111 formed in the pressure chamber part 105 and the ink passage part 106 and connected with an external ink tank (not shown). In the nozzle plate 113, nozzle holes 114 respectively connected with the ink discharge passages 108 are formed.

On the upper surface of the pressure chamber part 105 of the head body 101, a piezoelectric actuator 121 is disposed. The piezoelectric actuator 121 includes one common electrode 122 of Cr that covers all the concaves 102 of the head body 101 so as to form pressure chambers 103 together with the concaves 102 and is shared by all piezoelectric devices 123 described below. The common electrode 122 also works as the so-called vibration plate. Furthermore, the piezoelectric actuator 121 includes the piezoelectric devices 123 of lead zirconate titanate (PZT) disposed on the upper surface of the common electrode 122 correspondingly to the respective pressure chambers 103, and an individual electrode 124 of Pt disposed on each piezoelectric device 123 for applying a voltage to the corresponding piezoelectric device 123 together with the common electrode 122.

When a pulse voltage is applied between the common electrode 122 and each individual electrode 124, each piezoelectric device 123 shrinks in a lateral direction perpendicular to a thickness direction, but the common electrode 122 and the individual electrode 124 do not shrink. Therefore, a portion of the common electrode 122 corresponding to the piezoelectric device 123 is deformed into a convex projecting toward the pressure chamber 103 due to the so-called bimetal effect. This deformation causes a pressure within the pressure chamber 103, and owing to the pressure, ink contained in the pressure chamber 103 is jetted from the nozzle hole 114 through the discharge port 102*b* and the ink discharge passage 108.

In the ink-jet head for jetting ink by using the piezoelectric actuator 121 as described above, various improvements have been recently made so as to meet strict demands for compactness and light weight, a low driving voltage, low noise, low cost, and high controllability in jetting ink. In order to attain further compactness and higher performance, the common electrode 122, the piezoelectric devices 123 and the individual electrodes 124 can be formed from thin films easily subjected to refined processes.

In this case, for example, a method of manufacturing an ink-jet head shown in FIGS. 10(*a*) through 10(*g*) can be adopted. In FIGS. 10(*a*) through 10(*g*), the ink-jet head is shown upside down, namely, inversely to that shown in FIGS. 7 and 8.

Specifically, a Pt film 142 is formed on the entire surface of a supporting substrate 141 of MgO as is shown in FIG. 10(*a*), and then, the Pt film 142 is patterned (separated), thereby forming a plurality of individual electrodes 124 as is shown in FIG. 10(*b*).

Subsequently, a PZT film 143 is formed on the entire supporting substrate 141 bearing the individual electrodes 124 as is shown in FIG. 10(*c*), and the PZT film 143 is patterned into the same shape as the Pt film 142. Thus, a plurality of piezoelectric devices 123 are formed as is shown in FIG. 10(*d*).

Next, on the piezoelectric devices 123, a common electrode 122 (of a Cr film) is formed as is shown in FIG. 10(*e*), and the common electrode 122 is fixed on a pressure chamber part 105 as is shown in FIG. 10(*f*).

Then, the supporting substrate 141 is melted and removed by using heated phosphoric acid or the like, and the pressure chamber part 105 is fixed on an ink passage part 106 and a nozzle plate 113 previously integrated as is shown in FIG. 10(*g*). Thereafter, wiring of the individual electrodes 124 and other necessary processes are conducted, resulting in completing the ink-jet head.

In the above-described method of manufacturing an ink-jet head, however, it is particularly difficult to form the common electrode 122 in the shape of a thin film. Specifically, in a method where the common electrode 122 is formed by adhering a previously formed Cr film onto the piezoelectric devices 123 with an adhesive, the film is so thin that it is difficult to adhere it onto the piezoelectric devices 123. On the other hand, in a method in which the common electrode 122 is directly formed on the piezoelectric devices 123 by sputtering or the like, good adhesion can be attained and the thickness can be very small. However, the common electrode 122 cannot be formed into a flat shape on the entire surface of the supporting substrate 141 because the portion thereof on the supporting substrate 141 where the individual electrodes 124 and the piezoelectric devices 123 are not formed is placed at a lower level. Specifically, a portion of the common electrode 122 corresponding to an interval between the piezoelectric devices 123 can be formed in a lower level down to the surface of the supporting substrate 141 as is shown in FIG. 11(*a*). As a result, portions of the common electrode 122 corresponding to the respective piezoelectric devices 123 can be separated from one another. Alternatively, the portion of the common electrode 122 corresponding to the interval between the piezoelectric devices 123 can be largely bent toward the supporting substrate 141 as is shown in FIG. 11(*b*). When the common electrode 122 is separated as described above, it is troublesome because the separated portions of the common electrode 122 should be electrically connected through a wire. When the common electrode 122 is bent as described above, the displacement characteristic is varied in the piezoelectric actuator 121 and the common electrode 122 can be easily damaged.

In the above-described manufacturing method, another method can be adopted as follows instead of patterning the PZT film 143: The common electrode 122 is formed on the entire PZT film 143, and the common electrode 122 is fixed on the pressure chamber part 105. After removing the supporting substrate 141, the PZT film 143 is patterned on its face on the same side as the individual electrodes 124, thereby forming the piezoelectric devices 123. This method is not impossible but is actually difficult to adopt because the common electrode 122 and the piezoelectric devices 123 cannot resist heat applied during the patterning. In particular, when the common electrode 122 and the piezoelectric devices 123 have small sizes, this method is further difficult to adopt.

The present invention was devised in view of the aforementioned problems and disadvantages, and an object of the invention is attaining compactness of an ink-jet head for jetting ink by using the piezoelectric effect of a piezoelectric device with the displacement characteristic and durability of a piezoelectric actuator improved as far as possible.

SUMMARY OF THE INVENTION

In order to achieve the object, according to the invention, a plane where a common electrode is to be formed is flattened before forming the common electrode.

Specifically, the method of manufacturing an ink-jet head for jetting ink by using a piezoelectric effect of a piezoelectric device of this invention comprises the steps of forming plural individual electrodes and plural piezoelectric devices stacked in this order on a supporting substrate; flattening a top surface of the supporting substrate including the individual electrodes and the piezoelectric devices by filling a filler in a portion on the supporting substrate where the individual electrodes and the piezoelectric devices are not formed up to substantially the same level as a level of upper surfaces of the piezoelectric devices; forming a common electrode on the entire flattened top surface of the supporting substrate; fixing a pressure chamber part for forming pressure chambers on the common electrode; and removing the supporting substrate after fixing the pressure chamber part on the common electrode.

In this manner, the top surface of the supporting substrate where the common electrode is to be formed is flattened, and hence, the common electrode can be formed uniformly in a flat shape on the entire top surface of the supporting substrate by sputtering or vacuum evaporation. As a result, even a compact ink-jet head can be free from variation of the displacement characteristic of the piezoelectric actuator and damage of the common electrode. Thus, the ink-jet head attains high ink-jetting performance and high durability.

In the method of manufacturing an ink-jet head, the filler is preferably made from an organic resin, a photosensitive resin or polyimide. Thus, the filler can be easily filled by spin coating or the like, resulting in improving the productivity.

Alternatively, the filler can be made from an inorganic insulating material. Thus, the filler of $SiO_2$ or the like can be easily formed by sputtering or the like, and the filler can attain high environment resistance and reliability.

When the filler is made from an inorganic insulating material, the step of flattening the top surface of the supporting substrate preferably includes steps of forming an inorganic insulating material film on the entire top surface of the supporting substrate; and removing, by lapping followed by polishing, a portion of the inorganic insulating material film disposed above the upper surfaces of the piezoelectric devices. In this manner, the portion of the inorganic insulating material film disposed above the upper surfaces of the piezoelectric devices can be roughly abraded by lapping and mirror-ground by polishing. As a result, the entire top surface of the supporting substrate can be uniformly and definitely flattened.

In this case, the step of removing the portion of the inorganic insulating material film disposed above the upper surfaces of the piezoelectric devices preferably includes lapping by using abrasive grains of cerium oxide and polishing by using a non-metal soft material. Thus, even when there is a large difference in hardness between the inorganic insulating material to be abraded and the material for the piezoelectric devices, the entire top surface of the supporting substrate can be uniformly flattened.

Also, when the filler is made from an inorganic insulating material, the step of flattening the top surface of the supporting substrate can include steps of forming an inorganic insulating material film on the entire top surface of the supporting substrate; flattening an upper surface of the inorganic insulating material film by etch back; and removing a portion of the inorganic insulating material film, whose upper surface has been flattened, disposed above the upper surfaces of the piezoelectric devices. In this manner, the upper surface of the hard inorganic insulating material film can be easily flattened to some extent, resulting in easing removal of the inorganic insulating material film through lapping and polishing.

Furthermore, when the filler is made from an inorganic insulating material, the step of flattening the top surface of the supporting substrate can include steps of forming an inorganic insulating material film on the entire top surface of the supporting substrate by bias sputtering; and removing a portion of the inorganic insulating material film disposed above the upper surfaces of the piezoelectric devices. In this manner, the upper surface of the inorganic insulating material film can be flattened to some extent in forming the inorganic insulating material film by the bias sputtering, resulting in easing removal of the inorganic insulating material film through lapping and polishing.

Alternatively, the ink-jet head of this invention comprises a head body including plural concaves for pressure chambers each having a supply port for supplying ink and a discharge port for discharging ink; and a piezoelectric actuator including a common electrode covering the concaves for forming the pressure chambers together with the concaves; piezoelectric devices separately disposed on a surface of the common electrode opposite to the pressure chambers respectively correspondingly to the pressure chambers; individual electrodes separately disposed on surfaces of the piezoelectric devices opposite to the common electrode for applying a voltage to the piezoelectric devices together with the common electrode; and a filler filled in a portion on the surface of the common electrode opposite to the pressure chambers where the piezoelectric devices and the individual electrodes are not formed, for placing a surface of the filler opposite to the pressure chambers at substantially the same level as surfaces of the individual electrodes opposite to the pressure chambers, and the piezoelectric actuator is deformed, under application of a voltage to the piezoelectric devices through the individual electrodes and the common electrode, so as to reduce a volume of the pressure chambers, whereby allowing ink contained in the pressure chambers to be discharged through the discharge ports.

Owing to this structure, an ink-jet head having high ink-jetting performance and high durability can be manufactured by the aforementioned manufacturing method. Furthermore, the filler can protect the piezoelectric actuator from a mechanical external force derived from some accident or mis-operation as well as can make stress transmission between the common electrode and the side walls of the piezoelectric devices smooth. As a result, the life of the piezoelectric devices can be elongated.

In the ink-jet head, the filler is preferably made from an insulating material whose Young's modulus is set to be 1/20 or less of a Young's modulus of the piezoelectric devices. Thus, the filler can be substantially prevented from obstructing the operation of the piezoelectric actuator. As a result, the piezoelectric actuator can attain a very good displacement characteristic.

Furthermore, in the ink-jet head, the common electrode and the piezoelectric devices preferably have a thickness of 5 $\mu$m or less. Thus, by adopting the aforementioned method, the effects of the invention of attaining a good displacement characteristic and high durability of a piezoelectric actuator can be maximumly exhibited in a compact ink-jet head.

DETAILED DESCRIPTION OF THE INVENTION

A preferred embodiment of the invention will now be described with reference to the accompanying drawings.

Figure 1:
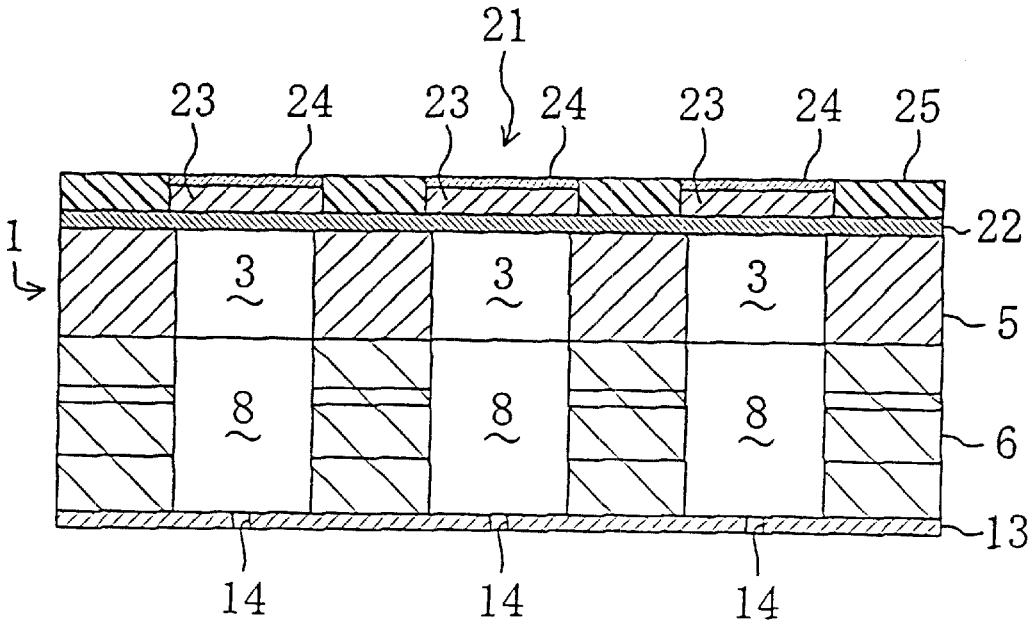
FIG. 1 is a sectional view of an ink-jet head according to an embodiment of the invention taken along a lateral direction of a piezoelectric device (corresponding to line I—I of FIG. 3)
Figure 2:
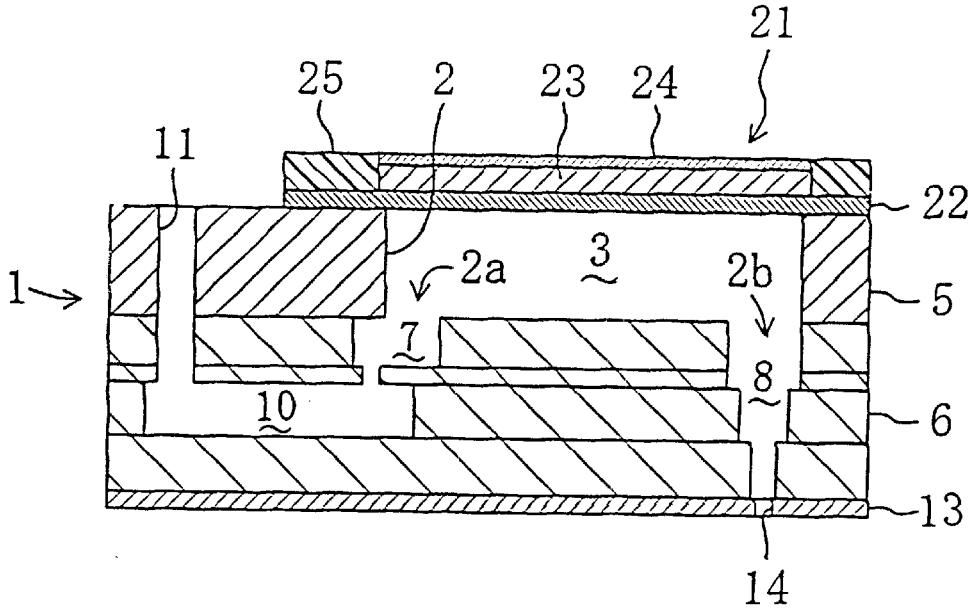
FIG. 2 is a sectional view of the ink-jet head taken along a longitudinal direction of the piezoelectric device (corresponding to line II—II of FIG. 3)
Figure 3:
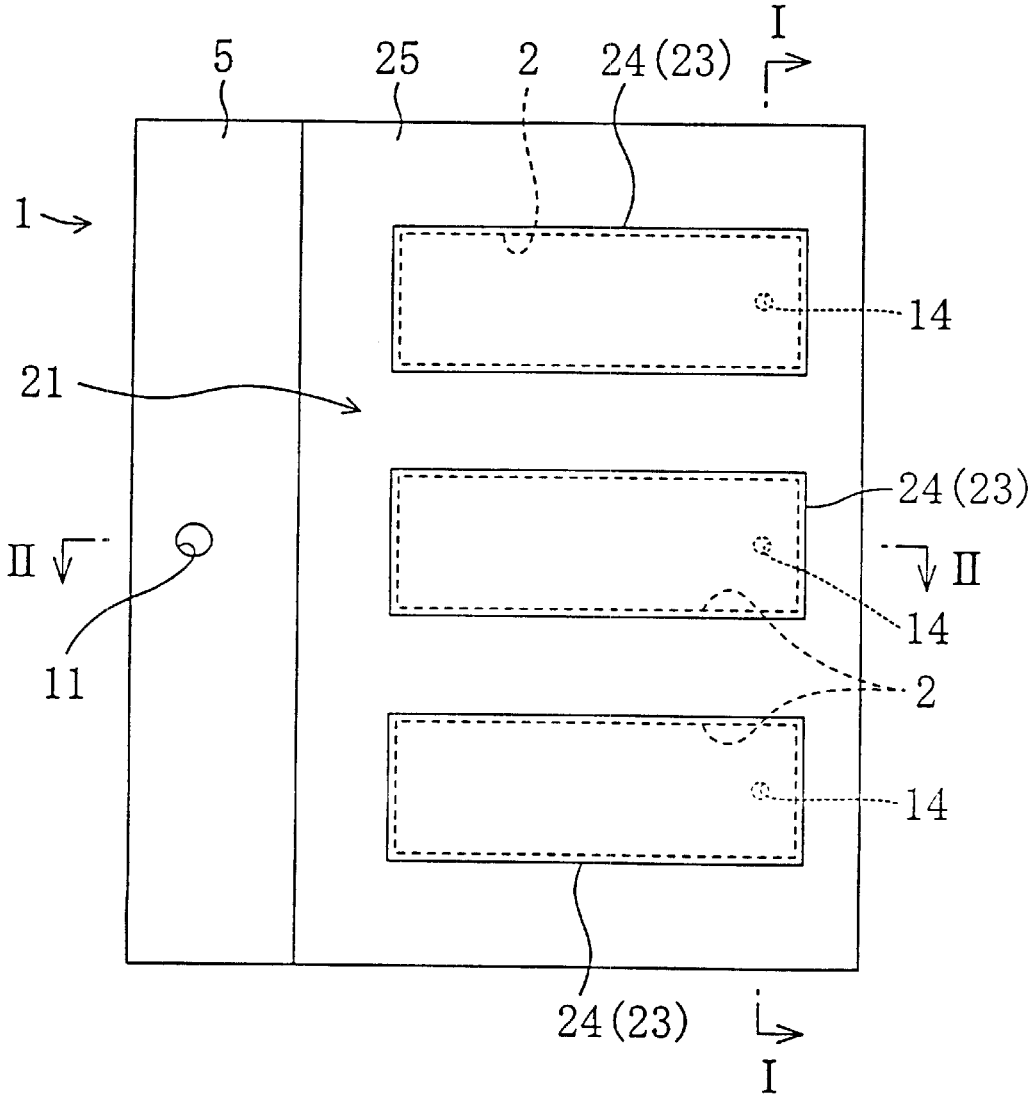
FIG. 3 is a plan view of the ink-jet head.
Figure 4A:
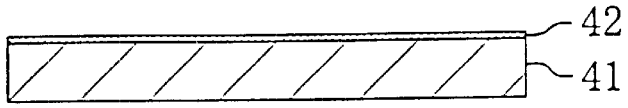
FIGS. 4(*a*) through 4(*h*) are schematic diagrams for showing a method of manufacturing the ink-jet head.
Figure 4B:
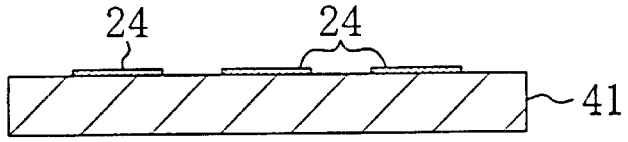
Figure 4C:
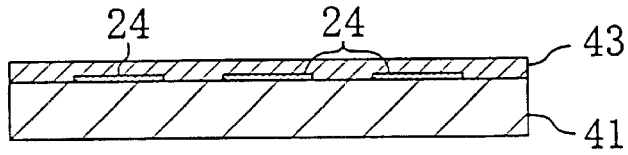
Figure 4D:
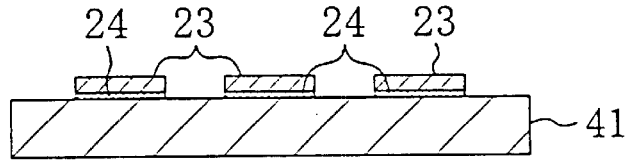
Figure 4E:
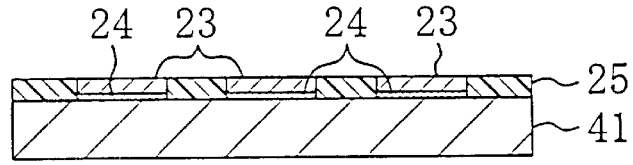
Figure 4F:
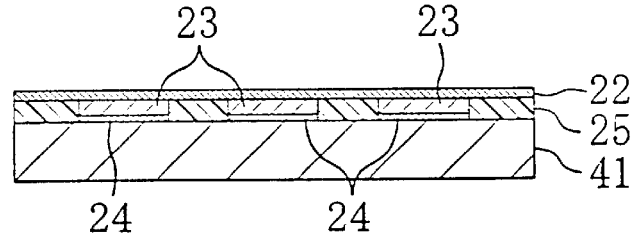
Figure 4G:
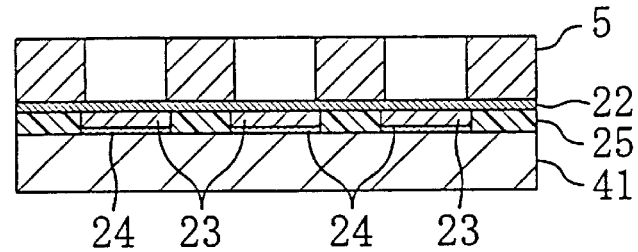
Figure 4H:
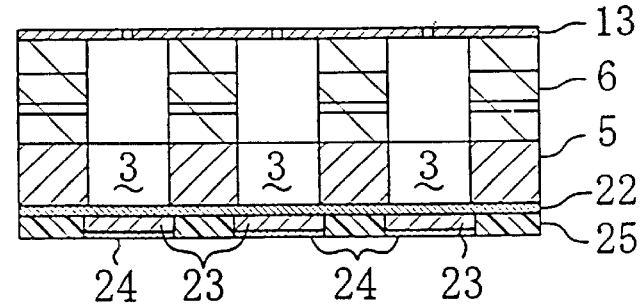
Figure 5A:
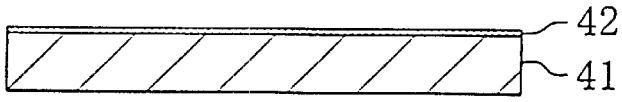
FIGS. 5(*a*) through 5(*g*) are schematic diagrams for showing another method of manufacturing the ink-jet head.
Figure 5B:
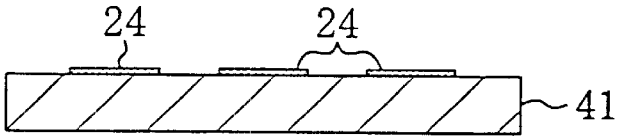
Figure 5C:
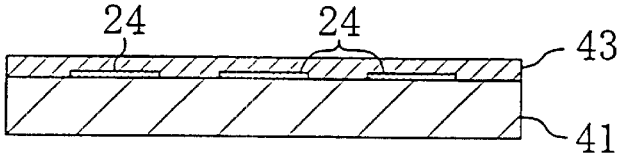
Figure 5D:
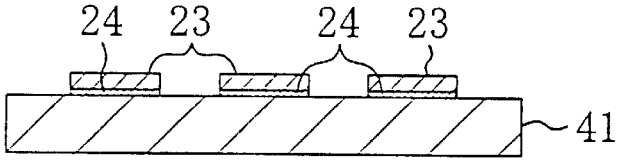
Figure 5E:
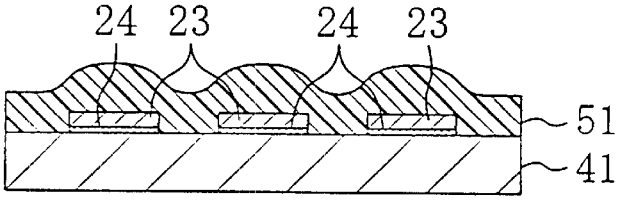
Figure 5F:
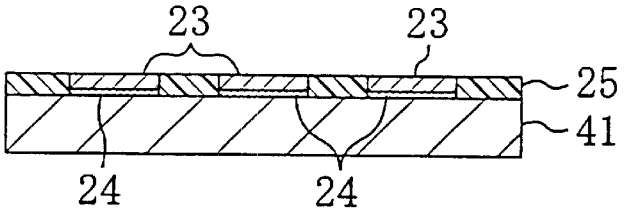
Figure 5G:
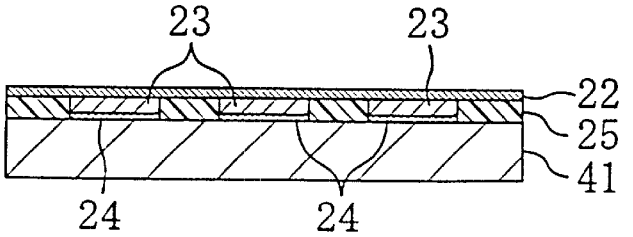
Figure 6A:
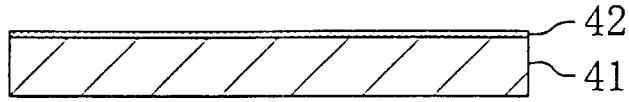
FIGS. 6(*a*) through 6(*h*) are schematic diagrams for showing still another method of manufacturing the ink-jet head.
Figure 6B:
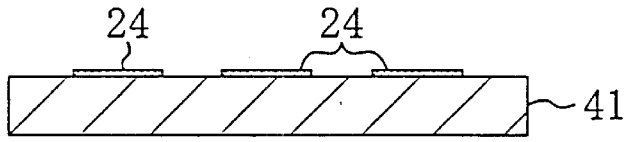
Figure 6C:
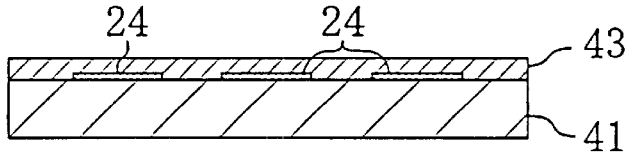
Figure 6D:
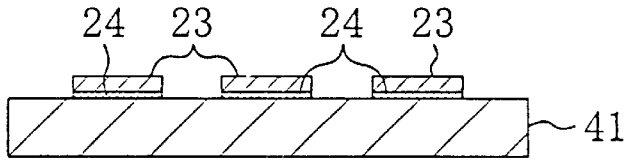
Figure 6E:
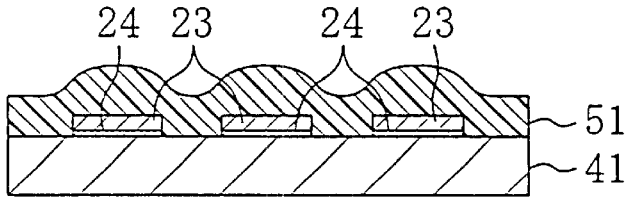
Figure 6F:
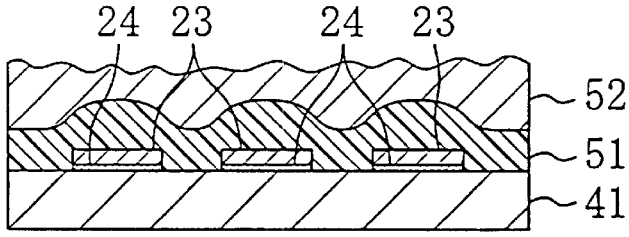
Figure 6G:
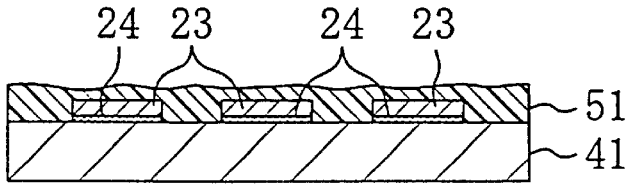
Figure 6H:
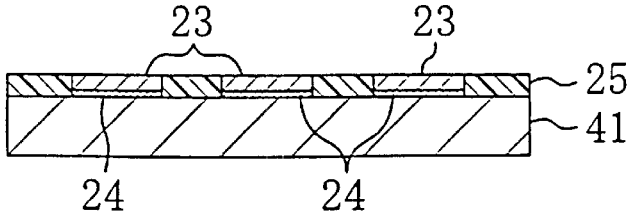
Figure 7:
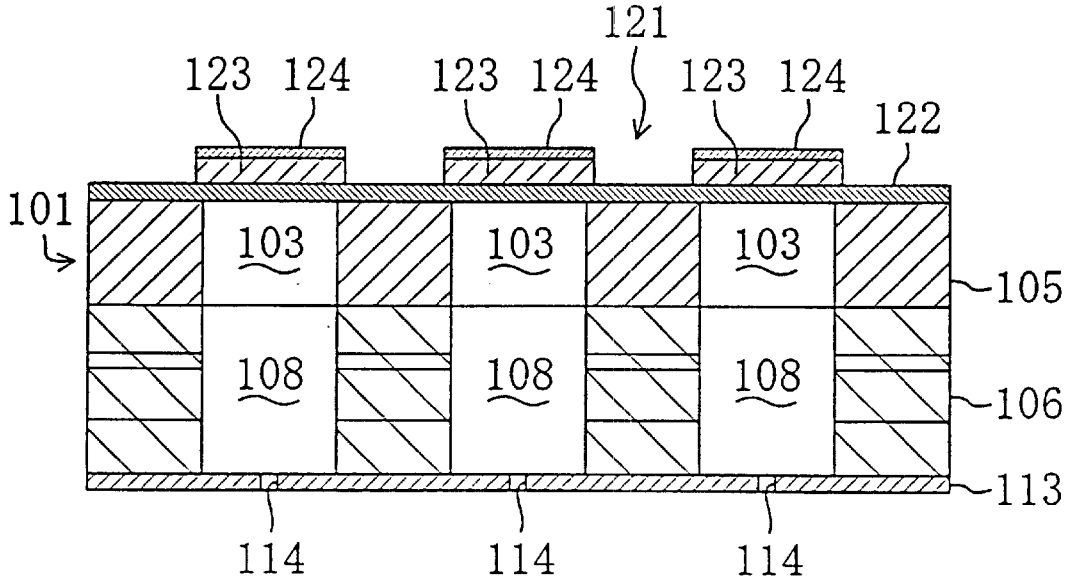
Fig. 7 Prior Art
FIG. 7 is a sectional view of a conventional ink-jet head taken along a lateral direction of a piezoelectric device (corresponding to line VII—VII of FIG. 9)
Figure 8:
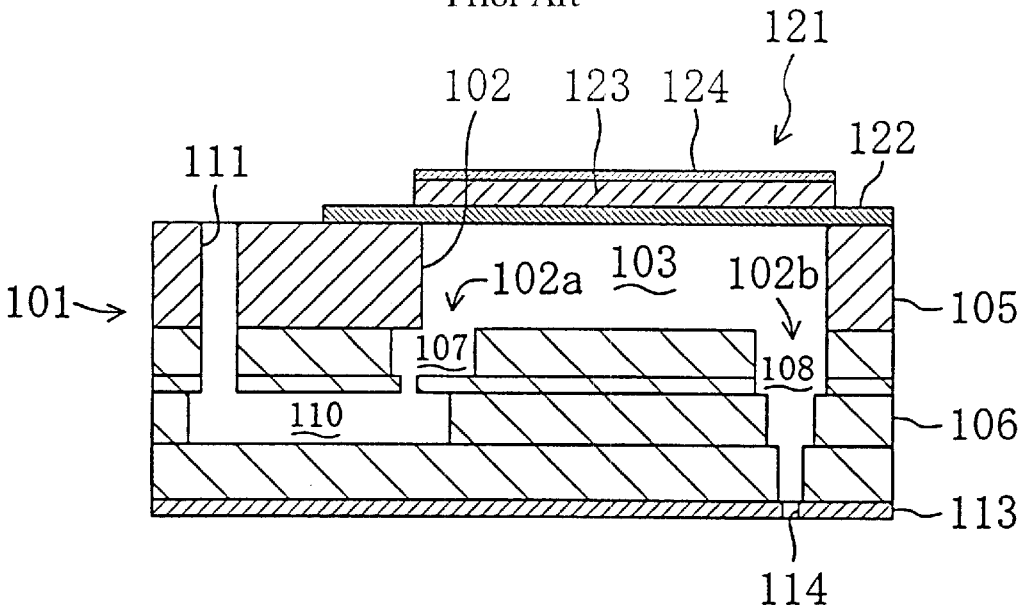
Fig. 8 Prior Art
FIG. 8 is a sectional view of the conventional ink-jet head taken along a longitudinal direction of the piezoelectric device (corresponding to line VIII—VIII of FIG. 9)
Figure 9:
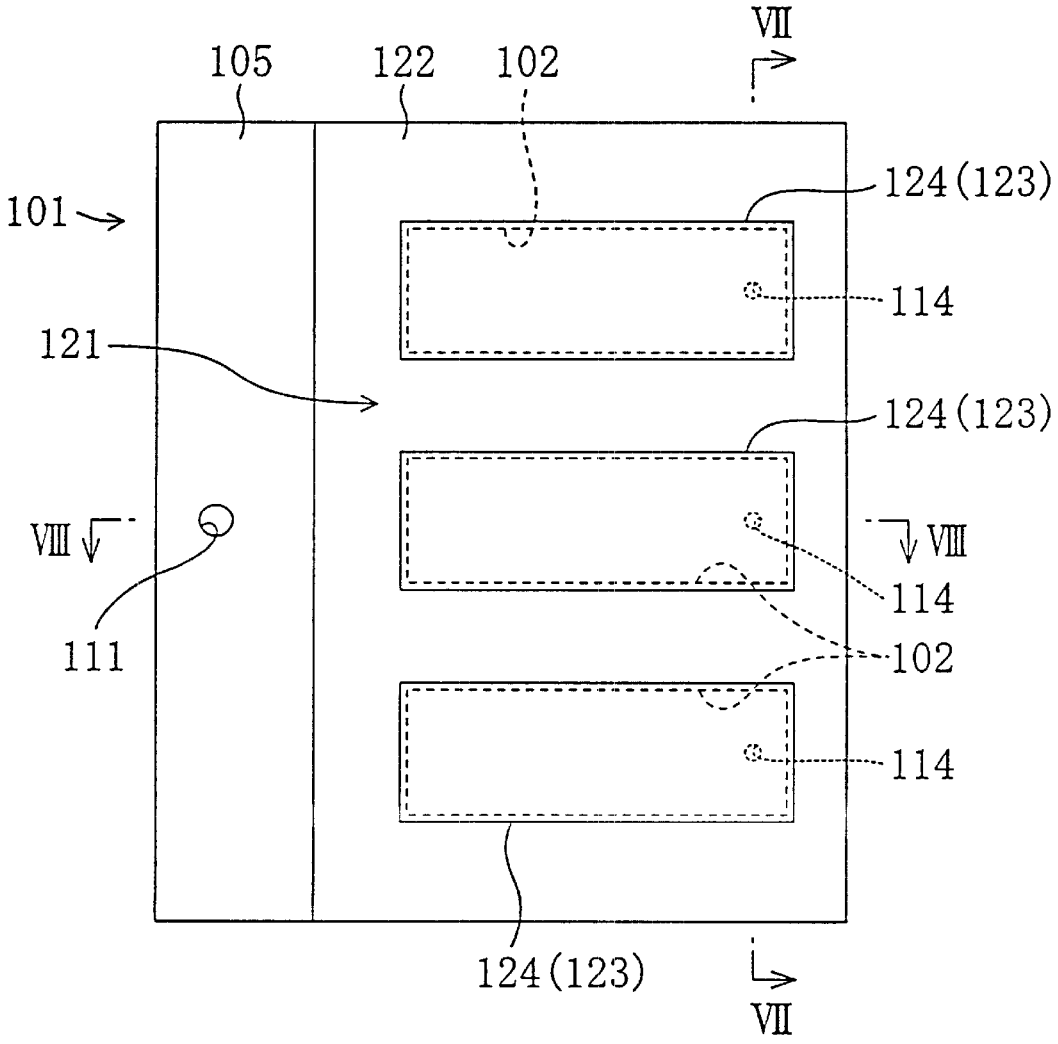
Fig. 9 Prior Art
FIG. 9 is a plan view of the conventional ink-jet head.
Figure 10A:
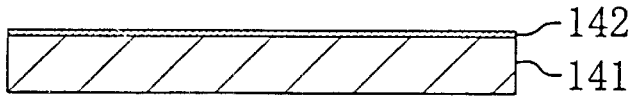
Fig. 10(a) Prior Art
FIGS. 10(*a*) through 10(*g*) are schematic diagrams for showing a method of manufacturing the conventional ink-jet head.
Figure 10B:
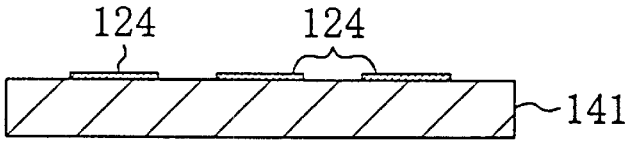
Fig. 10(b) Prior Art
Figure 10C:
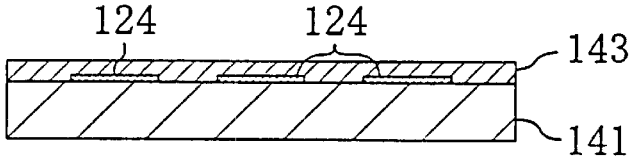
Fig. 10(c) Prior Art
Figure 10D:
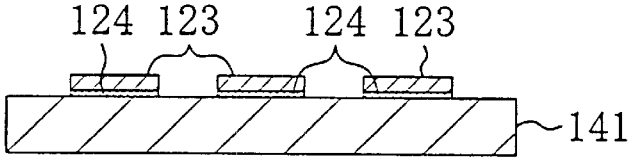
Fig. 10(d) Prior Art
Figure 10E:
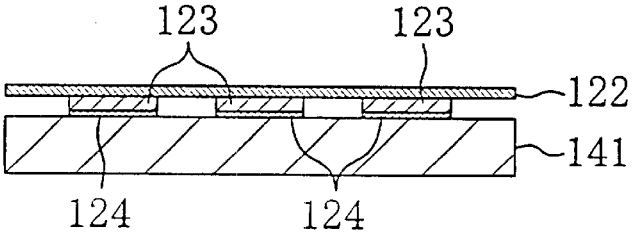
Fig. 10(e) Prior Art
Figure 10F:
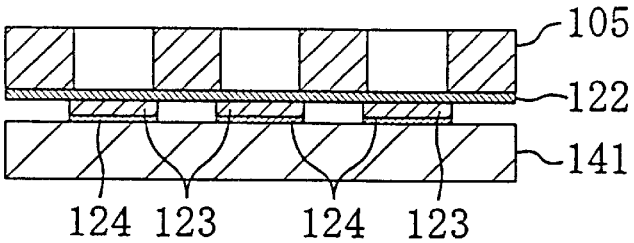
Fig. 10(f) Prior Art
Figure 10G:
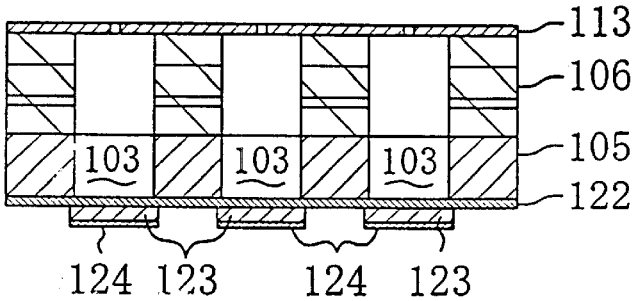
Fig. 10(g) Prior Art
Figure 11A:
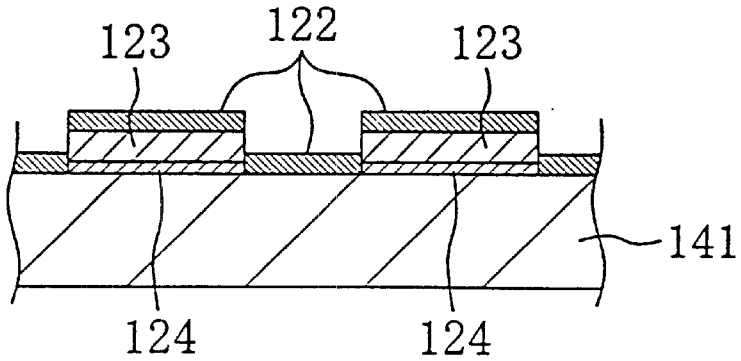
FIGS. 11(*a*) and 11(*b*) are schematic diagrams for showing states of a common electrode directly formed on piezoelectric devices by sputtering or the like in the manufacture of the conventional ink-jet head.
Figure 11B:
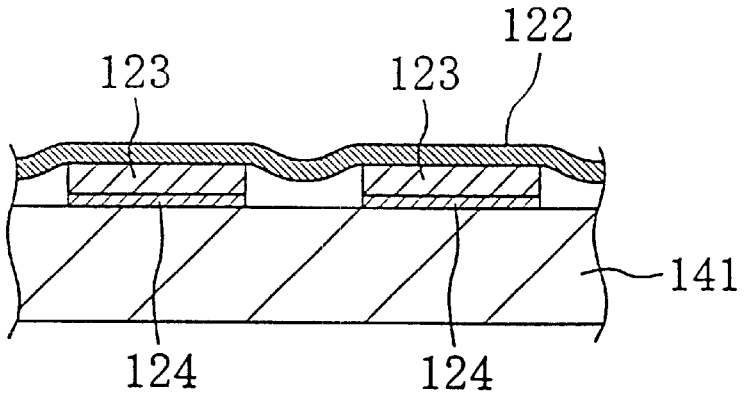

FIGS. 1 through 3 show an ink-jet head according to an embodiment of the invention. The ink-jet head comprises a head body 1 including a plurality of concaves 2 for pressure chambers each having a supply port 2*a* for supplying ink and a discharge port 2*b* for discharging ink. The respective concaves 2 of the head body 1 are formed on one outside surface (upper surface) of the head body 1 each in a substantially rectangular shape and arranged along one direction with predetermined intervals. Although merely three concaves 2 (each including a nozzle hole 14, a common electrode 22, a piezoelectric device 23, an individual electrode 24 and the like described below) are shown for the sake of simplification in FIG. 3, a large number of concaves are actually formed.

The side walls of each concave 2 of the head body 1 are formed from a pressure chamber part 5 of photosensitive glass having a thickness of approximately 200 $\mu$m, and the bottom of each concave 2 is made from an ink passage part 6 fixed on the pressure chamber part 5 and including plural thin stainless steel plates adhered to one another. In the ink passage part 6, an ink supply passage 7 communicating with the supply port 2*a* of each concave 2 and an ink discharge passage 8 communicating with the discharge port 2*b* are formed. The ink supply passage 7 communicates with an ink supply chamber 10 extending in the direction of arranging the concaves 2, and the ink supply chamber 10 communicates with an ink supply hole 11 formed in the pressure chamber part 5 and the ink passage part 6 and connected with an external ink tank (not shown). On the surface of the ink passage part 6 opposite to the pressure chamber 5 (namely, on the lower surface), a nozzle plate 13 of a polymer resin, such as polyimide, with a thickness of approximately 10 through 75 $\mu$m is provided. In the nozzle plate 13, nozzle holes 14 each with a diameter of approximately 20 $\mu$m are formed so as to be respectively connected with the ink discharge passages 8. The nozzle holes 14 are linearly arranged in the direction of arranging the concaves 2.

On the surface of the pressure chamber part 5 of the head body 1 opposite to the ink passage part 6 (namely, on the upper surface), a piezoelectric actuator 21 is disposed. The piezoelectric actuator 21 includes a common electrode 22 of Cr that covers all the concaves 2 of the head body 1 so as to form pressure chambers 3 together with the concaves 2 and is shared by all piezoelectric devices 23 described below. The common electrode 22 also works as the so-called vibration plate, and preferably has a thickness of 5 $\mu$m or less, which is 1 through 3 $\mu$m in this embodiment.

The piezoelectric actuator 21 includes a piezoelectric device 23 of lead zirconate titanate (PZT) provided correspondingly to each pressure chamber 3 on the surface (upper surface) of the common electrode 22 opposite to the corresponding pressure chamber 3, and an individual electrode 24 of Pt with a thickness of approximately 0.1 μm provided on the surface (upper surface) of each piezoelectric device 23 opposite to the common electrode 22 for applying a voltage to the piezoelectric device 23 together with the common electrode 22. Each piezoelectric device 23 preferably has a thickness of 5 μm or less, which is 2 through 5 μm in this embodiment.

On the surface of the common electrode 22 opposite to the pressure chambers 3, a filler 25 of polyimide is provided in portions where the piezoelectric devices 23 and the individual electrodes 24 are not formed. The surface (upper surface) of the filler 25 opposite to the pressure chambers 3 is placed at substantially the same level as the surfaces (upper surfaces) of the individual electrodes 24 opposite to the pressure chambers 3.

Now, procedures in a method of manufacturing this ink-jet head will be described with reference to FIGS. 4(*a*) through 4(*h*). In FIGS. 4(*a*) through 4(*h*), the ink-jet head is shown upside down, namely, inversely to that shown in FIGS. 1 and 2.

First, a Pt film 42 is formed on the entire surface of a supporting substrate 41 of MgO by sputtering as is shown in FIG. 4(*a*). Then, the Pt film 42 is patterned (separated) into the plural individual electrodes 24 as is shown in FIG. 4(*b*). Subsequently, on the entire top surface of the supporting substrate 41 bearing the individual electrodes 24, a PZT film 43 is formed as is shown in FIG. 4(*c*), and the PZT film 43 is patterned into the same shape as the Pt film 42, thereby forming the plural piezoelectric devices 23 as is shown in FIG. 4(*d*). In other words, the plural individual electrodes 24 and the plural piezoelectric devices 23 are formed so as to be stacked up with the individual electrodes 23 placed closer to the supporting substrate 41. Alternatively, the individual electrodes 24 and the piezoelectric devices 23 can be obtained by forming the Pt film 42 and the PZT film 43 successively on the entire surface of the supporting substrate 41 and etching these films 42 and 43 substantially simultaneously.

Next, the filler 25 is filled in portions on the supporting substrate 41 where the individual electrodes 24 and the piezoelectric devices 23 are not formed up to substantially the same level as the upper surfaces of the piezoelectric devices 23, thereby flattening the top surface of the supporting substrate 41 including the individual electrodes 24 and the piezoelectric devices 23 as is shown in FIG. 4(*e*). Specifically, the filler 25 is filled by using a spin coater, and the top surf ace of the supporting substrate 41 is flattened through photolithography.

Then, a Cr film is formed by sputtering on substantially the entire flattened surface of the supporting substrate 41, thereby forming the common electrode 22 as is shown in FIG. 4(*f*). At this point, since substantially the entire top surface of the supporting substrate 41 is flattened, the common electrode 22 can be uniformly formed in a flat shape over the supporting substrate 41 even when the Cr film is thin.

Subsequently, the pressure chamber part 5 is fixed on the common electrode 22 as is shown in FIG. 4(*g*). Then, the supporting substrate 41 is removed by melting with heated phosphoric acid or the like, and the ink passage part 6 and the nozzle plate 13 previously integrated are fixed on the pressure chamber part 5 as is shown in FIG. 4(*h*). Then, although not shown in the drawings, wiring of the individual electrodes 24 and other necessary processes are conducted, resulting in completing the ink-jet head. In removing the supporting substrate 41 by melting with heated phosphoric acid or the like, the piezoelectric devices 23 could be damaged by the heated phosphoric acid or the like if the filler 25 was not provided. The piezoelectric devices 23 are, however, covered with the filler 25 and the individual electrodes 24, and hence are prevented from being damaged by the heated phosphoric acid or the like.

Next, the operation of the ink-jet head will be described. By applying a voltage between the common electrode 22 and each individual electrode 24, the portion of the common electrode 22, serving as a vibration plate, corresponding to the pressure chamber 3 can be deformed so as to reduce the volume of the pressure chamber 37 thereby discharging ink contained in the pressure chamber 3 through the dishcarge port 2*b*. In other words, when a pulse voltage is applied to each piezoelectric device 23 through the common electrode 22 and the individual electrode 24, the piezoelectric device 23 shrinks in a lateral direction perpendicular to a thickness direction at a rise of the pulse voltage, but the common electrode 22 does not shrink. Therefore, the portion of the piezoelectric actuator 21 corresponding to the pressure chamber 3 is deformed to displace toward the pressure chamber 3. This deformation causes a pressure within the pressure chamber 3, and a predetermined amount of ink contained in the pressure chamber 3 is discharged by this pressure through the discharge port 2*b* and the ink discharge passage 8 to be jetted externally (onto paper to be printed) through the nozzle hole 14, resulting in adhering onto the paper in the shape of dots. Then, at a fall of the pulse voltage, the piezoelectric device 23 elongates in the lateral direction, so that the common electrode 22 can return to the original state. At this point, fresh ink is filled in the pressure chamber 3 from the ink supply chamber 10 through the ink supply passage 7 and the supply port 2*a*. Not only ink of a single color but also ink of, for example, black, cyan, magenta and yellow can be respectively jetted through different nozzle holes 14, so as to realize color printing.

In this manner, substantially the entire top surface of the supporting substrate 41 is flattened before forming the common electrode 22 in the aforementioned embodiment. Therefore, the common electrode 22 can be uniformly formed in a flat shape over the entire supporting substrate 41. As a result, the displacement characteristic can be prevented from varying during the operation of the piezoelectric actuator 21 and the common electrode 22 can be prevented from being damaged. In addition, the filler 25 is made from polyimide and hence has a Young's modulus as small as 1/20 or less (1/33 based on a certain measured value) of that of the piezoelectric device 23. Therefore, there is substantially no fear of the filler 25 obstructing the operation of the piezoelectric actuator 21. Furthermore, the filler 25 can protect the piezoelectric actuator 21 from a mechanical external force derived from some accident or mis-operation. In addition, the filler 25 can make smooth stress transmission between the common electrode 22 having a large Young's modulus and the side faces of the piezoelectric devices 23. Accordingly, a compact ink-jet head can be easily manufactured with keeping the ink-jetting performance and the durability satisfactorily.

Although the filler 25 is made from polyimide in the above-described embodiment, the filler 25 can be made from any of various organic resins and photosensitive resins. In view of the operation of the piezoelectric actuator 21, an insulating material with a Young's modulus set as small as 1/20 or less of that of the piezoelectric device 23 is preferably selected as the material for the filler 25.

Alternatively, the filler 25 can be made from an inorganic insulating material such as alumina, $SiO_2$ and $Si_3N_4$. A method of manufacturing the ink-jet head by using such a material as the filler 25 will now be described with reference to FIGS. 5(*a*) through 5(*g*), in which description of procedures shown in FIGS. 5(*a*) through 5(*d*) are omitted because they are respectively the same as the procedures shown in FIGS. 4(*a*) through 4(*d*).

In flattening the top surface of the supporting substrate 41 by filling the filler 25 in the portions on the supporting substrate 41 where the individual electrodes 24 and the piezoelectric devices 23 are not formed, an inorganic insulating material film 51 is first formed by sputtering, evaporation or CVD on the entire top surface of the supporting substrate 41 as is shown in FIG. 5(*e*). Then, a portion of the inorganic insulating material film 51 disposed above the upper surfaces of the piezoelectric devices 23 is removed by lapping followed by polishing so as to expose the upper surfaces of the piezoelectric devices 23 (in general, the piezoelectric devices 23 are slightly removed) as is shown in FIG. 5(*f*). Specifically, the surface is roughly flattened through lapping conducted with a lapping machine by using cerium oxide with an average particle size of 1 $\mu$m as abrasive grains and a mixed solution of glycerin, ethanol and water as a lubricating oil. Then, the surface is mirror-ground by polishing with buffing using a non-metal soft material such as phenol resin. In this manner, the top surface of the supporting substrate 41 can be well flattened even when there is a large difference in hardness between the piezoelectric devices 23 and the inorganic insulating material film 51. However, the method for flattening is not limited to this method. Thus, the top surface of the supporting substrate 41 is flattened with the filler 25 filled in the portion on the supporting substrate 41 where the individual electrodes 24 and the piezoelectric devices 23 are not formed up to substantially the same level as the upper surfaces of the piezoelectric devices 23.

Next, the common electrode 22 is formed by forming a Cr film by sputtering on substantially the entire flattened top surface of the supporting substrate 41 as is shown in FIG. 5(*g*). Subsequently, although not shown in the drawings, the pressure chamber part 5 is fixed on the common electrode 22, the supporting substrate 41 is melted and removed, and the ink passage part 6 and the nozzle plate 13 previously integrated are fixed on the pressure chamber part 5 in the same manner as in the aforementioned embodiment. Ultimately, the filler 25 of the inorganic insulating material is preferably removed so as not to. remain as in the aforementioned embodiment. This is because this filler 25 tends to degrade the displacement characteristic of the piezoelectric actuator 21 differently from the resin such as polyimide used in the aforementioned embodiment. It goes without saying that the filler 25 of polyimide can be also removed in the aforementioned embodiment.

Alternatively, in the case where the filler 25 is made from an inorganic insulating material, after forming the inorganic insulating material film 51, the upper surface of the inorganic insulating material film 51 can be flattened by etch back, and then, a portion of the flattened inorganic insulating material film 51 disposed above the upper surfaces of the piezoelectric devices 23 can be removed by polishing (or lapping followed by polishing). Procedures for manufacturing the ink-jet head by this method will now be described with reference to FIGS. 6(*a*) through 6(*h*), in which procedures shown in FIGS. 6(*a*) through 6(*e*) are omitted because they are respectively the same as the procedures shown in FIGS. 5(*a*) through 5(*e*). Specifically, after forming the inorganic insulating material film 51 on the entire top surface of the supporting substrate 41 as is shown in FIG. 6(*e*), an organic film 52 of photoresist or polyimide is formed by spin coating on the entire inorganic insulating material film 51 as is shown in FIG. 6(*f*). Then, the organic film 52 is dry etched from its upper surface, thereby removing projecting portions on the upper surface of the inorganic insulating material film 51 for rough flattening. At this point, the inorganic insulating material film 51 and the organic film 52 should be etched at substantially the same rate, which can be attained by adjusting the composition of an etching gas to be used. For example, when flon ($CF_4$) alone is used as the etching gas, the inorganic insulating material film 51 of $Si_3N_4$ alone is etched. When oxygen is used together, however, the organic film 52 is also etched, and the same etching rate can be attained by appropriately adjusting the mixing ratio between flon and oxygen. Through this etching, the organic film 52 is entirely removed and the upper surface of the inorganic insulating material film 51 is flattened to some extent as is shown in FIG. 6(*g*). Subsequently, a portion of the inorganic insulating material film 51 disposed above the upper surfaces of the piezoelectric devices 23 is removed by polishing as is shown in FIG. 6(*h*). At this point, lapping can be conducted before polishing. The procedures for forming the common electrode 22 and the like to be conducted thereafter are the same as those of the aforementioned embodiment. When the upper surface of the inorganic insulating material film 51 is thus flattened by etch back, the portion of the inorganic insulating material film 51 disposed above the upper surfaces of the piezoelectric devices 23 can be efficiently removed.

Alternatively, the inorganic insulating material film 51 can be formed by bias sputtering, so as to remove a portion of the inorganic insulating material film 51 formed by the bias sputtering disposed above the upper surfaces of the piezoelectric devices 23. The bias sputtering is a kind of sputtering in which a film is formed under application of a negative bias voltage to the supporting substrate 41. In the bias sputtering, part of ions included in plasma enters the surface of the supporting substrate 41, so as to cause sputtering etching simultaneously with deposition of the film. When the inorganic insulating material film 51 is formed by the bias sputtering, the inorganic insulating material film 51 can be flattened to some extent by setting the sputtering amount in areas above the upper surfaces of the piezoelectric devices 23 smaller than in the other area. Then, the portion of the inorganic insulating material film 51 disposed above the upper surfaces of the piezoelectric devices 23 is removed by lapping followed by polishing, and the procedures for forming the common electrode 22 and the like to be conducted thereafter are the same as those in the aforementioned embodiment. Also when the inorganic insulating material film 51 is formed by the bias sputtering and the upper surface thereof is flattened, the inorganic insulating material film 51 can be efficiently removed.

In addition, although each concave 2 of the head body 1 and each piezoelectric device 23 of the piezoelectric actuator 21 are formed in a rectangular shape in the above-described embodiment, the concave 2 and the piezoelectric device 23 can be formed in an elliptical shape or any other shape.

Moreover, various modification can be made in the invention. For example, the materials and the thicknesses of the common electrode 22, the piezoelectric devices 23, the individual electrodes 24 and the like of the piezoelectric actuator 21 can be different from those described in the embodiment (for example, the common electrode 22 can be made from Ni or Ti). Also, the materials and the thicknesses of the pressure chamber part 5, the ink passage part 6 and the nozzle plate 13 of the head body 1 can be different from those described in the embodiment.

Furthermore, without using the common electrode 22 also working as the vibration plate, a separate vibration plate of, for example, ceramic can be provided with forming the common electrode 22 from, for example, Au. In this case, the common electrode 22 can be obtained by forming an Au film by sputtering on substantially the entire flattened top surface of the supporting substrate 41, and the pressure chamber part 5 is fixed on the common electrode 22 with a vibration plate of ceramic or the like disposed therebetween.

What is claimed is:

1. An ink-jet head comprising:

a head body including plural concaves for pressure chambers each having a supply port for supplying ink and a discharge port for discharging ink; and a piezoelectric actuator including:

a common electrode covering said concaves for forming said pressure chambers together with said concaves;

piezoelectric devices separately disposed on a surface of said common electrode opposite to said pressure chambers respectively correspondingly to said pressure chambers;

individual electrodes separately disposed on surfaces of said piezoelectric devices opposite to said common electrode for applying a voltage to said piezoelectric devices together with said common electrode; and a filler filled in a portion on the surface of said common electrode opposite to said pressure chambers where said piezoelectric devices and said individual electrodes are not formed, for placing a surface of said filler opposite to said pressure chambers at substantially the same level as surfaces of said individual electrodes opposite to said pressure chambers, wherein said piezoelectric actuator is deformed, under application of a voltage to said piezoelectric devices through said individual electrodes and said common electrode, so as to reduce a volume of said pressure chambers, whereby allowing ink contained in said pressure chambers to be discharged through said discharge ports.

2. The ink-jet head of claim 1, wherein said filler is made from an insulating material whose Young's modulus is set to be 1/20 or less of a Young's modulus of said piezoelectric devices.

3. The ink-jet head of claim 1, wherein said common electrode and said piezoelectric devices have a thickness of 5 $\mu$m or less.

* * * * *

UNITED STATES PATENT AND TRADEMARK OFFICE

CERTIFICATE OF CORRECTION

PATENT NO. : 6,443,566 B1
DATED : September 3, 2002
INVENTOR(S) : Osamu Watanabe et al.

It is certified that error appears in the above-identified patent and that said Letters Patent is hereby corrected as shown below:

Title page,
Item [54], Title, "INK-JET HEAD AND METHOD OF MANUFACTURING THE SAME" should be -- "INK-JET HEAD" --.

Signed and Sealed this

Seventh Day of October, 2003

JAMES E. ROGAN
*Director of the United States Patent and Trademark Office*